US008272847B2

(12) United States Patent
Lee et al.

(10) Patent No.: US 8,272,847 B2
(45) Date of Patent: Sep. 25, 2012

(54) RECIPROCATING COMPRESSOR

(75) Inventors: Yun-Hi Lee, Gyeongsangnam-Do (KR); Sang-Joon Eum, Gyeongsangnam-Do (KR); Seoung-Min Kang, Gyeongsangnam-Do (KR); Yoon-Sung Choi, Gyeongsangnam-Do (KR); Bum-Dong Sa, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 12/449,369

(22) PCT Filed: Feb. 4, 2008

(86) PCT No.: PCT/KR2008/000677

§ 371 (c)(1),
(2), (4) Date: Aug. 5, 2009

(87) PCT Pub. No.: WO2008/096999

PCT Pub. Date: Aug. 14, 2008

(65) Prior Publication Data

US 2010/0322790 A1 Dec. 23, 2010

(30) Foreign Application Priority Data

Feb. 6, 2007 (KR) ..... 10-2007-0012327

(51) Int. Cl.
*F04B 1/06* (2006.01)

(52) U.S. Cl. ..... 417/221; 417/218

(58) Field of Classification Search ..... 417/218, 417/221, 222.1

See application file for complete search history.

(56) References Cited

U.S. PATENT DOCUMENTS

| | | | | |
|---|---|---|---|---|
| 4,236,874 | A * | 12/1980 | Sisk | 417/315 |
| 4,245,966 | A * | 1/1981 | Riffe | 417/539 |
| 4,494,447 | A * | 1/1985 | Sisk | 92/13.3 |
| 6,132,177 | A * | 10/2000 | Loprete et al. | 417/221 |
| 6,190,137 | B1 * | 2/2001 | Robbins et al. | 417/221 |
| 6,446,451 | B1 * | 9/2002 | Monk et al. | 62/228.5 |
| 6,755,624 | B2 * | 6/2004 | Bae et al. | 417/221 |
| 2003/0235510 | A1 * | 12/2003 | Kim et al. | 418/219 |

FOREIGN PATENT DOCUMENTS

| | | | |
|---|---|---|---|
| JP | 2006-125384 | A | 5/2006 |
| KR | 10-2004-0038377 | A | 5/2004 |
| KR | 10-2006-0035009 | A | 4/2006 |

* cited by examiner

*Primary Examiner* — Devon Kramer
*Assistant Examiner* — Thomas Fink
(74) *Attorney, Agent, or Firm* — McKenna Long & Aldridge LLP

(57) ABSTRACT

The present invention relates to a reciprocating compressor. The reciprocating compressor includes a latching unit by which a piston is reciprocated by two times a total eccentric amount obtained by adding an eccentric amount of an eccentric portion to an eccentric amount of an eccentric sleeve in a power mode, while the piston is reciprocated by two times the eccentric amount of the eccentric portion in a saving mode, accordingly the piston can have an upper dead point same in the power mode and the saving mode, thereby reducing a dead volume between the piston and a discharge valve and increasing a variable ratio of a cooling capacity of the compressor in the saving mode.

4 Claims, 7 Drawing Sheets

--Prior Art--

--Prior Art--

--Prior Art--

RECIPROCATING COMPRESSOR

This application is a national stage entry of International Application No.

PCT/KR2008/000677, filed Feb. 4, 2008, and claims the benefit of Korean Application No. 10-2007-0012327, filed on Feb. 6, 2007, which is hereby incorporated by reference for all purposes as if fully set forth herein.

TECHNICAL FIELD

The present invention relates to a reciprocating compressor, more particularly, to a reciprocating compressor for compressing a refrigerant by converting a rotary motion of a driving motor into a linear motion of a piston.

BACKGROUND ART

A compressor serves to convert mechanical energy into compressive energy of fluid. Compressors may be categorized into a reciprocating type, a rotary type, a vane type and a scroll type according to a compressing mechanism with respect to fluid.

The reciprocating compressor is provided with a driving motor for generating a rotational force and a compression unit for compressing a refrigerant, a fluid, by receiving a driving force from the driving motor, within a hermetic container.

The compression unit serves to compress the refrigerant by a reciprocating motion of a piston connected to a crankshaft by a connecting rod, in a cylinder. Currently, a variable capacity type reciprocating compressor which is capable of adjusting a compression capacity according to a size of a refrigerating load has been developing. A double-capacity reciprocating compressor (hereafter, abbreviated to "double-capacity compressor") among the variable capacity type reciprocating compressor has the piston having a stroke that is variable according to a rotation direction of the crankshaft, and accordingly, operated in a power mode or a saving mode.

FIG. 1 is an exemplary view showing the related double-capacity compressor.

As shown, in the related double-capacity compressor, an eccentric portion 3 is formed at a crankshaft 2 of a driving motor 1 rotated in a forward direction and a reverse direction according to an operation mode of the compressor, and an eccentric sleeve 4 is rotatably and eccentrically coupled to the eccentric portion 1. Further, a connecting rod 5 is rotatably connected to the eccentric sleeve 4, and a piston 6 performing a rotary motion in a cylinder (C) is coupled to an end of the connecting rod 5.

A latching unit 7 is installed at the eccentric portion 1 of the crankshaft. The latching unit 7 is protruded by a centrifugal force and then stopped by a stopping ends 4*a*, 4*b* of the eccentric sleeve 4 so that the stroke of the piston 6 is variable according to the operation mode of the compressor.

In the related double-capacity compressor, when the crankshaft is rotated by a power applied to the driving motor, the latching unit 7 installed at the eccentric portion 1 of the crankshaft is protruded and then coupled to a first stopping end 4*a* or a second stopping end 4*b* of the eccentric sleeve 4 according to the operation mode thereof. And, the eccentric sleeve 4 is eccentrically rotated together with the crankshaft, accordingly the connecting rod 5 is rotated and the piston 6 coupled to the connecting rod 5 is reciprocated within the cylinder (C), thereby compressing the refrigerant.

Here, as shown in FIG. 2, in the power mode by which the crankshaft is rotated in the reverse direction (counterclockwise rotation), the piston 6 is reciprocated by two times a total eccentric amount (E+ϵ) obtained by adding an eccentric amount (E) of the eccentric portion to an eccentric amount (ϵ) of the eccentric sleeve so that the compressor can be operated by a maximum cooling capacity. On the contrary, as shown in FIG. 3, in the saving mode by which the crankshaft is rotated in the forward direction (clockwise rotation), the piston 6 is reciprocated by two times a total eccentric amount (E−ϵ) obtained by subtracting the eccentric amount (ϵ) of the eccentric sleeve from the eccentric amount (E) of the eccentric portion so that the compressor can be operated by a minimum cooling capacity.

However, the related double-capacity compressor is operated by the eccentric amount that is obtained by subtracting the eccentric amount (ϵ) of the eccentric sleeve from the eccentric amount (E) of the eccentric portion in the saving mode, accordingly an upper dead point of the piston 6 cannot reach the end (position where a discharge valve is located) of the cylinder (C). Accordingly, as shown in FIG. 3, a dead volume is generated, thereby limiting increasing a variable ratio of the cooling capacity.

DISCLOSURE OF THE INVENTION

Technical Problem

Therefore, it is an object of the present invention to provide a reciprocating compressor which is capable of reducing a dead volume by having a piston having an upper dead point same in a power mode and a saving mode.

Technical Solution

To achieve the object, in accordance with one aspect of the present invention, there is provided a reciprocating compressor comprising an eccentric portion formed at a crankshaft that is bi-directionally rotating, an eccentric sleeve eccentrically inserted into the eccentric portion, a connecting rod inserted into the eccentric sleeve, and a piston reciprocated in a cylinder by being coupled to the connecting rod, wherein the eccentric sleeve and the connecting rod are rotated with being locked to each other such that the reciprocating compressor is operated in a saving mode when the crankshaft is rotated in one direction, while the eccentric sleeve and the connecting rod are separately rotated with not being locked to each other such that the reciprocating compressor is operated in a power mode when the crankshaft is rotated in another direction.

In accordance with another aspect of the present invention, there is provided a reciprocating compressor comprising a crankshaft bi-directionally rotating and having an eccentric portion disposed to be eccentric from a center of the rotation of the crankshaft, an eccentric sleeve eccentrically inserted onto the eccentric portion of the crankshaft, a connecting rod having one end inserted in which the eccentric sleeve is inserted and another end coupled to a piston slidably inserted into a cylinder, and a latching unit by which the connecting rod and the eccentric sleeve are locked to each other and a bearing surface is provided between the eccentric portion of the crankshaft and the eccentric sleeve when the crankshaft is rotated in one direction, thereby being operated in a saving mode, while by which the eccentric portion of the crankshaft and the eccentric sleeve are locked to each other and the bearing surface is provided between the connecting rod and the eccentric sleeve when the crankshaft is rotated in another direction, thereby being operated in a power mode.

MODES FOR CARRYING OUT THE PREFERRED EMBODIMENTS

Hereafter, description will now be given in detail of the one embodiment of a reciprocating compressor according to the present invention with accompanying drawings.

Figure 1:
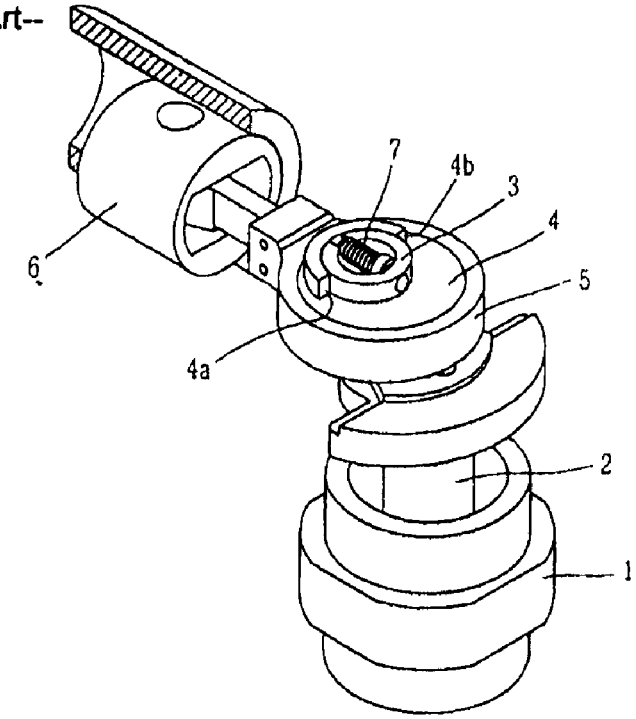
FIG. 1 is a perspective view of the related double-capacity reciprocating compressor.
Figure 2:
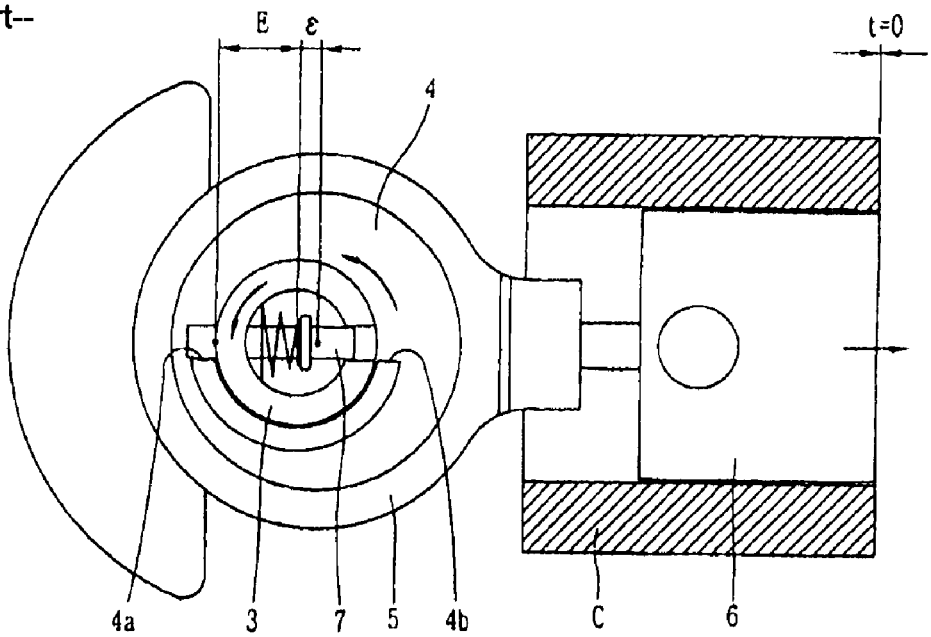
FIGS. 2 and 3 are schematic views showing variation of a stroke in a power mode and a saving mode in accordance with FIG. 1.
Figure 3:
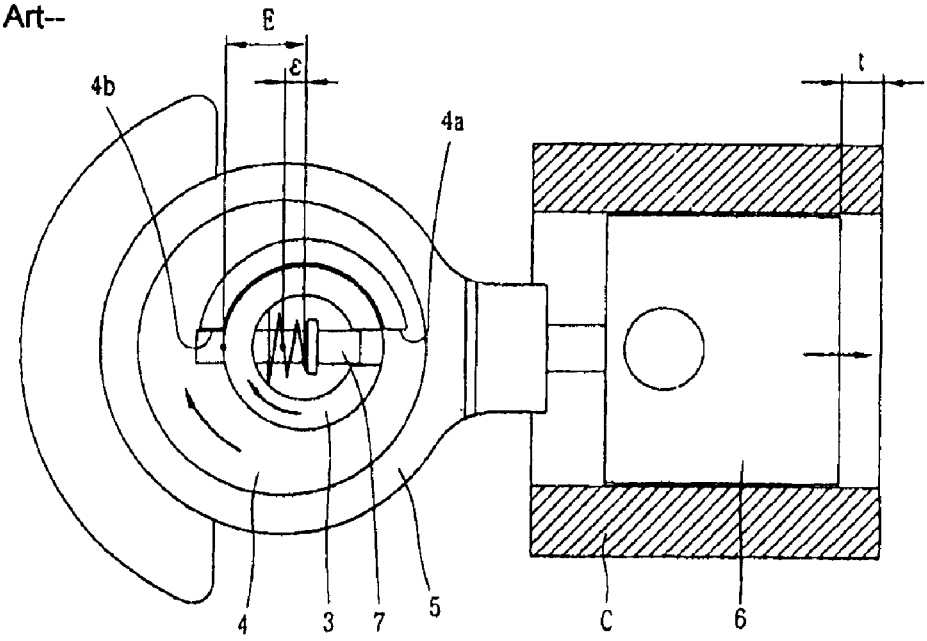
Figure 4:
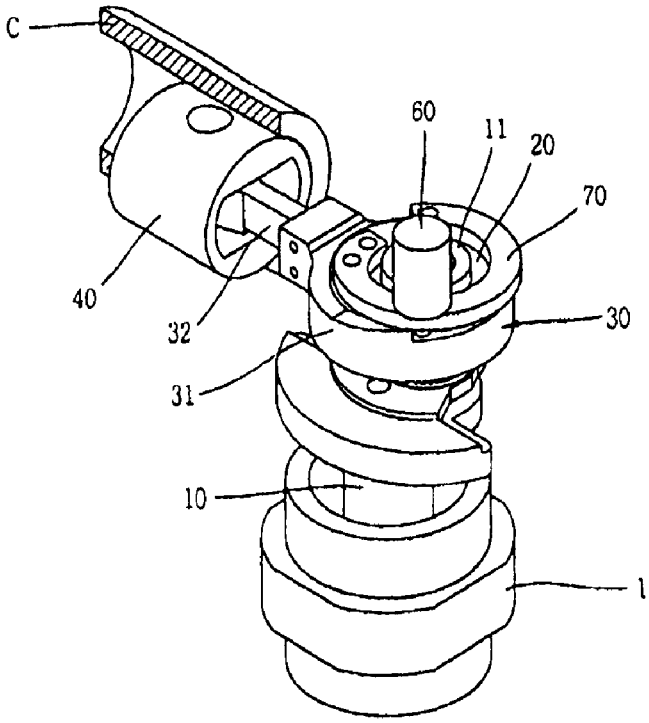
FIG. 4 is a perspective view showing a double-capacity reciprocating compressor in accordance with the present invention.

As shown in FIG. 4, the double-capacity compressor in accordance with the present invention includes a driving motor 1 installed in a hermetic container and rotated in both directions and a compression unit installed at an upper side of the driving motor 1, for compressing a refrigerant by receiving a rotational force from the driving motor 1.

The driving motor 1 is implemented as a constant speed motor or an inverter motor which can be rotated in a forward direction and a reverse direction, and includes a stator elastically installed in the hermetic container by being supported by a frame, a rotor rotatably installed in the stator and a crankshaft 10 for transferring the rotational force to the compression unit by being coupled to a center of the rotor.

Figure 5:
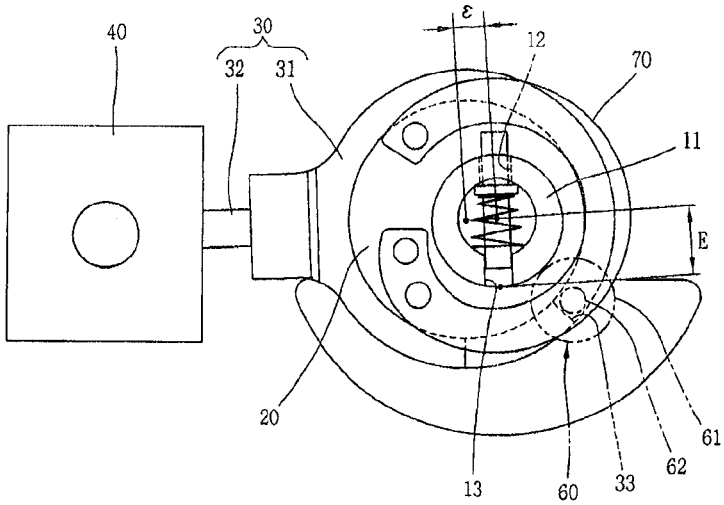
FIG. 5 is a planar view showing a compression unit of the compressor in accordance with FIG. 4.

As shown in FIG. 5, the crankshaft 10 has an upper end coupled to an eccentric sleeve 20 and includes an eccentric portion 11 eccentrically formed with a constant eccentric amount (E) from a center of the shaft so that a piston 40 can be reciprocated. The eccentric portion 11 is provided with a pin hole 12 and a pin groove 13 formed on a same line with a phase difference of approximately 180° so that a first latching pin 51 to be described may be movably coupled thereto in a radial direction.

The compression unit includes the eccentric sleeve 20 rotatably coupled to the eccentric portion 11 of the crankshaft 10, a connecting rod 30 coupled to an outer circumferential surface of the eccentric sleeve 20 in the radial direction, for converting a rotary motion of the crankshaft 10 into a linear motion, the piston 40 coupled to the other end of the connecting rod 30 and reciprocating in a compression space of the cylinder (C) in the radial direction, for compressing the refrigerant, a first latching unit 50 installed between the eccentric portion 11 of the crankshaft 10 and the eccentric sleeve 20 so that the eccentric sleeve 20 may be locked to or released from the crankshaft 10 according to the operation mode of the compressor, and a second latching unit 60 installed between the eccentric sleeve 20 and the connecting rod 30 so that the connecting rod 30 is locked to or released from the eccentric sleeve 20 according to the operation mode of the compressor.

The cylinder (C) formed in a cylindrical shape is integrally formed at the frame or assembled at the frame, and a valve assembly composed of a suction valve and a discharge valve is generally coupled to a front end of the cylinder (C).

Figure 6:
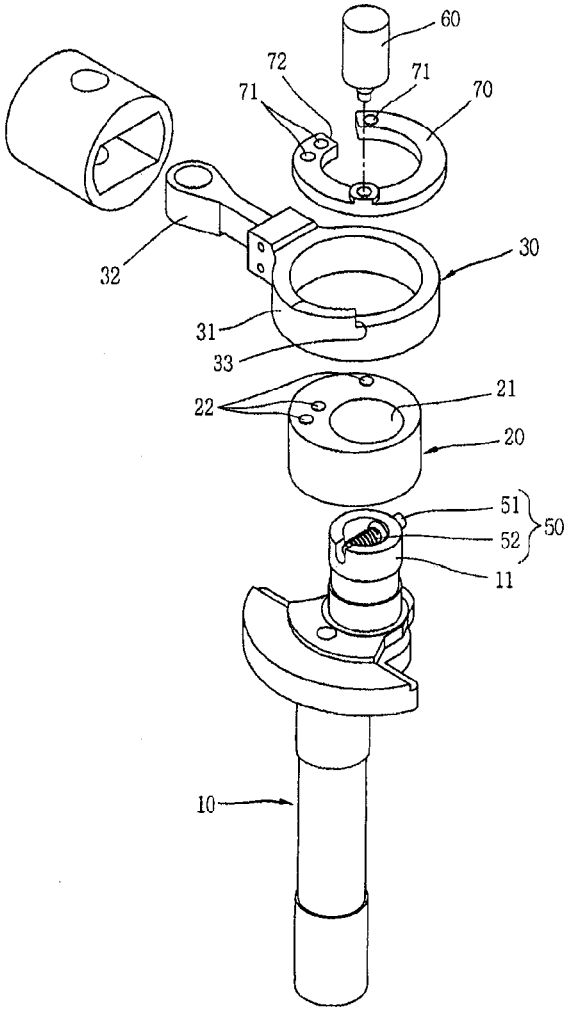
FIG. 6 is an exploded perspective view showing a main part of the compressor in accordance with FIG. 4.

As shown in FIG. 6, the eccentric sleeve 20 is formed in a disk shape having an outer circumferential surface formed in a right circular shape, and a shaft hole 21 is penetratingly formed at a part of the eccentric sleeve 20 eccentric from the center in one direction in a shaft direction so that the eccentric portion 11 of the crankshaft 10 may be rotatably coupled thereto.

The shaft hole 21 is formed to have a center having a constant eccentric amount ($\epsilon$) from the center of the eccentric sleeve 20. And, coupling grooves 22 are formed at the periphery of the shaft hole 21 so that a first pin stopper 70 to be described can be fixed thereto.

The connecting rod 30 includes a shaft connecting unit 31 rotatably coupled to the outer circumferential surface of the eccentric sleeve 20 and a piston connecting unit 32 extended from the shaft connecting unit 31 and rotatably coupled to the piston 40.

The shaft connecting unit 31 has an inner circumferential surface formed in a circular belt shape which is slidably contacted with the outer circumferential surface of the eccentric sleeve 20, and a second pin stopper 33 is formed at a central part of the upper surface of the shaft connecting unit 31 so that a second latching pin 62 to be described may slidably pass therethrough or be locked thereby according to the rotation direction.

Figure 7:
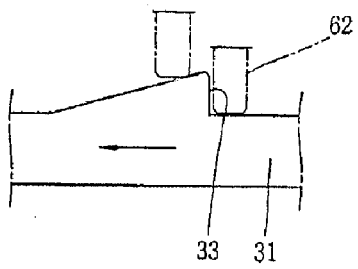
FIGS. 7 and 8 are schematic views showing embodiments of a second pin stopper of a connecting rod in accordance with FIG. 4.
Figure 8:
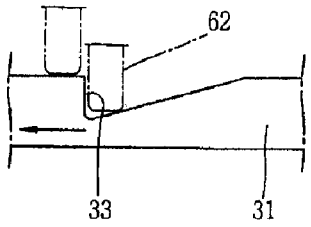
Figure 9:
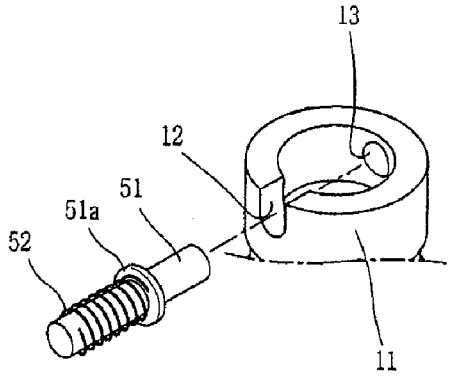
FIG. 9 is a perspective view showing a first latching pin of a first latching unit in accordance with FIG. 4.

As shown in FIG. 7, the second pin stopper 33 may be formed to have an inclined surface and a stepped surface consecutively protruded. Alternately, as shown in FIG. 8, the second pin stopper 33 may be formed to have the inclined surface and the stepped surface consecutively concaved. And, the second pin stopper 33 may be integrally formed at the shaft connecting unit 31 or assembled thereat.

The piston 40 is formed in a hollow cylindrical shape having a sealed one end, and the piston connecting unit 32 of the connecting rod 30 is rotatably coupled to an inner space of the piston 40.

The first latching unit 50 includes a first latching pin 51 installed at the eccentric portion 11 of the crankshaft 10 and locked to or released from a stopping end 72 of a first pin stopper 70 to be described, and a first pin spring 52 elastically supporting the first latching pin 51 always in a direction that the first latching pin 51 is drawn out.

The first latching pin 51 is formed in a rod shape so as to be coupled to the crankshaft 10 through the pin hole 12 and the pin groove 13 of the eccentric portion 11 of the crankshaft 10, and has a central part forming an extension unit 51*a* by being extended in a ring shape so as to be stopped by the pin hole of the eccentric portion 11.

The first pin spring 52 implemented as a compression coil spring having one end supported by the extension unit 51*a* of the first latching pin 51 and the other end supported by an inner circumferential surface around the pin groove 13 so as to support the first latching pin 51 always in the direction that the first latching pin 51 is drawn out.

Also, the first pin spring 52 may support that the first latching pin 51 disposed in the eccentric portion 11 is drawn out by a centrifugal force. The first pin spring 52 may be formed by a material or in a shape that can provide the first latching pin 51 with an elastic force, besides the compression coil spring.

Figure 10:
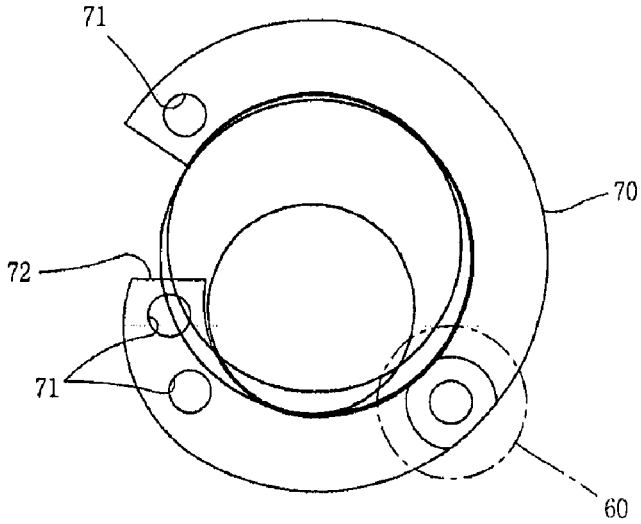
FIG. 10 is a planar view showing a first pin stopper in accordance with FIG. 4.

Here, as shown in FIG. 10, the first pin stopper 70 by which the first latching pin 51 is stopped so that the crankshaft 10 and the eccentric sleeve 20 are locked or released therebetween, is formed in a letter C shape and both ends thereof are coupled to the eccentric sleeve 20.

For this configuration, the first pin stopper 70 has both ends provided with a plurality of through holes 71 respectively corresponding to the coupling grooves 22 of the eccentric sleeve 20. Each through hole 71 may have the same size and the same number at both ends of the first pin stopper 70. But, since a large amount of loads are applied to the stopping end 72 by which the first latching pin 51 is stopped, as shown in FIGS. 5 and 10, it is preferable that the through holes formed at the stopping end 72 are greater in the number and larger in the size.

Also, preferably, the stopping end 72 of the first pin stopper 70 is disposed at a position that the eccentric portion 11 of the crankshaft 10 is eccentric from the piston 40 with the greatest eccentric amount, that is, that the first latching pin 51 is stopped on the same line with a virtual line connecting the center of the crankshaft 10 and the center of the eccentric portion 11, so as to maximize the eccentric amount of the eccentric sleeve 20.

Figure 11:
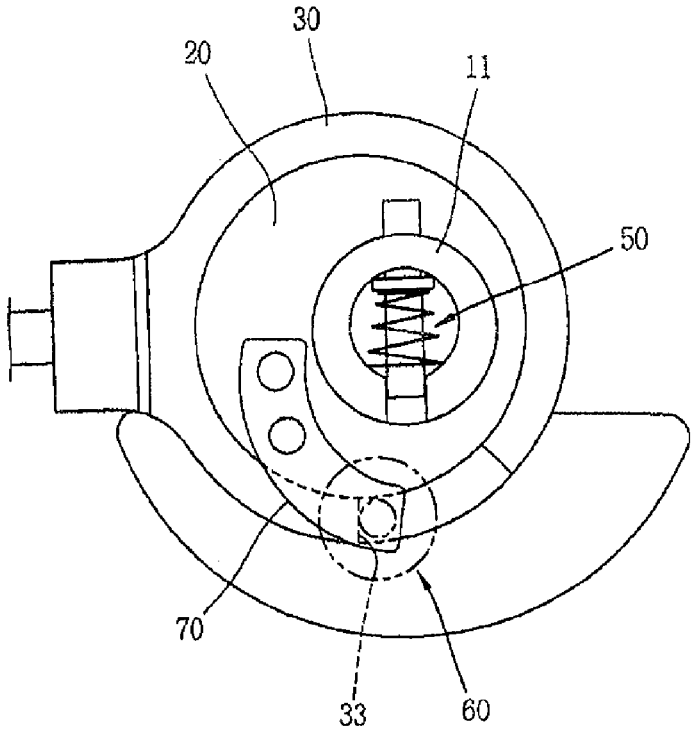
FIG. 11 is a planar view showing another embodiment of the first pin stopper in accordance with FIG. 4.

Also, the entire inner circumferential surface of the first pin stopper 70 may be formed in a shape that two or more circles (three circles in the drawing) are combined as shown in FIG. 10, so that the first latching pin 51 can be stopped by the stopping end 72 in the power mode, while the first latching pin 51 slidably passes through the inner circumferential surface of an opposite end of the stopping end 72 in the saving mode. Alternately, as shown in FIG. 11, the first pin stopper 70 may have the inner circumferential surface formed by one circle. In this case, preferably, the inner circumferential surface of the first pin stopper 70 is disposed to be eccentric from the center of the eccentric portion 11 of the crankshaft 10 so as to selectively lock the first latching pin 51 according to the operation mode. Also, since the first pin stopper 70 can be coupled to the stopping end by which the first latching pin 51 is stopped, the number and the size of bolt should be considered to stand the load when the first latching pin 51 is stopped at the stopping end.

Figure 12:
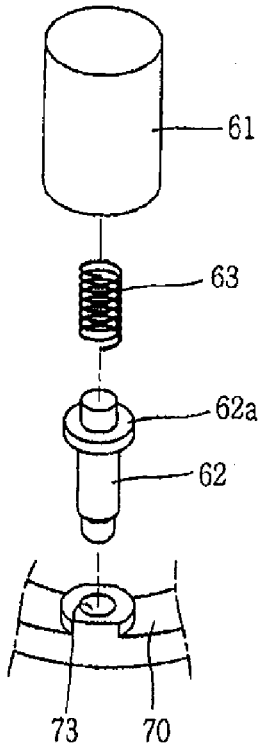
FIG. 12 is an exploded perspective view showing a second latching pin of a second latching unit in accordance with FIG. 4.

As shown in FIG. 12, the second latching unit 60 includes a pin housing 61 fixed to the upper surface of the first pin stopper 70, a second latching pin 62 elastically supported in the shaft direction by being received in the pin housing 61 and having an end locked to or released from the second pin stopper 33 of the connecting rod 30 through the pin hole 73 of the first pin stopper 70, and a second pin spring 63 disposed between the pin housing 61 and the second latching pin 62 so as to support the second latching pin 62 in a direction that the second latching pin 62 is always drawn out.

The pin housing 61 is formed in the hollow cylindrical shape having a sealed one side, and an opening thereof is fixably coupled to the upper surface of the first pin stopper 70.

The second latching pin 62 is formed in the rod shape and has the central part provided with a ring-shaped extension unit 62*a* so as to be supported by the second pin spring. And, preferably, the second latching pin 62 has the end formed in a spherical shape so as to reduce a friction loss considering that the end of the second latching pin 62 is always slidably contacted with the shaft connecting unit 31 of the connecting rod 30.

The second pin spring 63 implemented as the compression coil spring has one end supported by the pin housing 61 and the other end supported by being stopped by the extension unit 62*a* of the second latching pin 62. And, preferably, since the second pin spring 63 is installed to allow the second latching pin 62 to be downwardly drawn out, the second pin spring 63 has an elastic coefficient as small as possible, considering the friction loss between the second latching pin 62 and the connecting rod 30. And, as aforementioned, the second pin spring 63 may be formed by a material or in a shape that can provide the second latching pin 62 with the elastic force, besides the compression coil spring.

Here, preferably, a position the second latching pin 62 is locked by the second pin stopper 33 is consistent with a position that the eccentric sleeve 20 is eccentric from the piston 40 with the maximum state, thereby approaching the upper dead point of the piston 40 to the valve assembly as close as possible.

The stopping end 72 by which the first latching pin 51 is stopped may be formed by using the first pin stopper 33, but may be integrally formed at the eccentric sleeve 20. In this case, the first pin stopper 33 only serves to provide a portion for installing a part of the second latching unit 60 for selectively locking the eccentric sleeve 20 and the connecting rod 30.

The reciprocating compressor in accordance with the present invention will be operated as follows.

When a power is applied to a stator of the driving motor 1, the rotor is rotated together with the crankshaft 10 by a force caused by a reciprocal action between the stator and the rotor, and the connecting rod 30 coupled to the eccentric portion 11 of the crankshaft 10 disposing the eccentric sleeve 20 therebetween is rotated. And then, the piston 40 coupled to the connecting rod 30 is linearly reciprocated in the compression space of the cylinder (C), thereby compressing the refrigerant. This process is repeatedly performed.

It will be described in detail.

Figure 13:
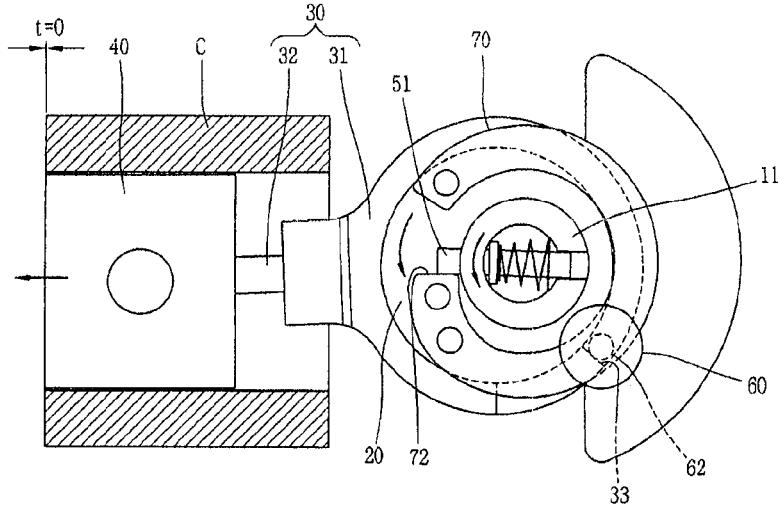
FIGS. 13 and 14 are planar views showing variation of a stroke in a power mode in accordance with FIG. 4.
Figure 14:
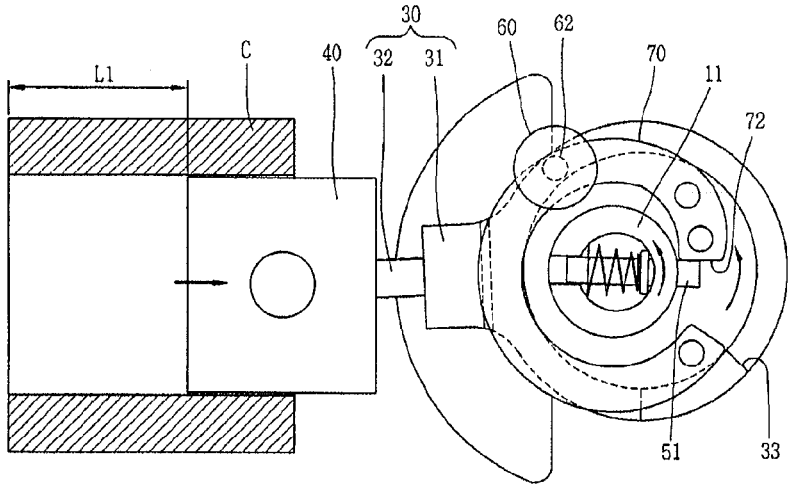

First, as shown in FIGS. 13 and 14, when the compressor is operated in the power mode, the crankshaft 10 is rotated in the reverse direction, a counterclockwise direction, and accordingly, the first latching pin 51 of the eccentric portion 11 of the crankshaft 10 is supported by the first pin spring 52, thereby being protruded in the radial direction and stopped by the stopping end 72 of the first pin stopper 70. Accordingly, the crankshaft 10 and the eccentric sleeve 20 are rotated with the maximum eccentric amount. Accordingly, the piston 40 is reciprocated by two times (L1) a total eccentric amount ($E+\epsilon$) obtained by adding the eccentric amount (E) of the eccentric portion to the eccentric amount ($\epsilon$) of the eccentric sleeve, causing the compressor to generate the maximum refrigerating capacity.

Figure 15:
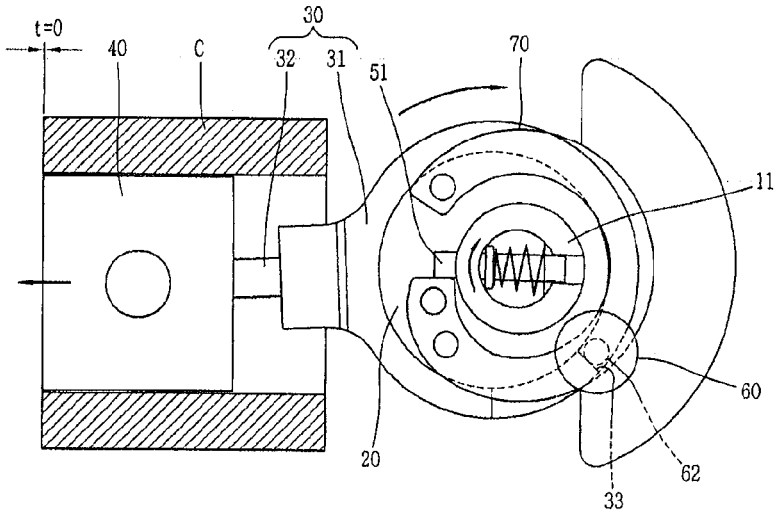
FIGS. 15 and 16 are planar views showing variation of a stroke in a saving mode in accordance with FIG. 4.
Figure 16:
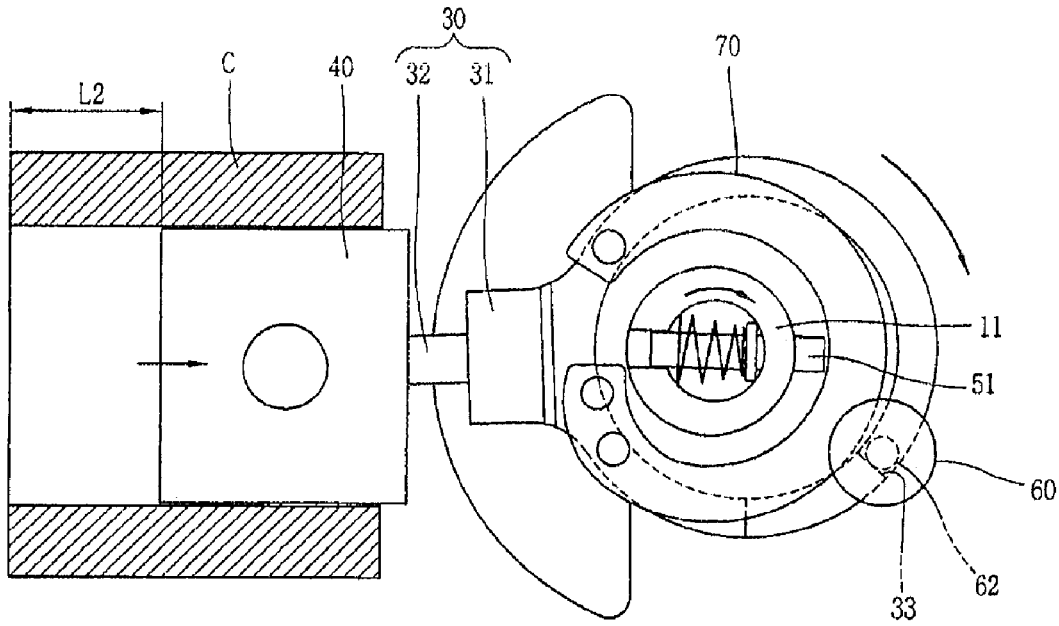

Meanwhile, as shown in FIGS. 15 and 16, when the compressor is operated in the saving mode, the crankshaft 10 is rotated in the forward direction, a clockwise direction, and accordingly, the first latching pin 51 is slid along the inner circumferential surface of the first pin stopper 70 without being stopped by the opposite end of the stopping end 72 of the first pin stopper 70 even though the first latching pin 51 is protruded by the first pin spring 52. Here, the eccentric sleeve 20 may have a tendency to rotate separately from the crankshaft 10, but, since the second latching pin 62 coupled to the first pin stopper 70 is rotated around the shaft connecting unit 31 of the connecting rod 30 and then stopped by the stepped surface of the second pin stopper 33, the eccentric sleeve 20 may be rotated together with the connecting rod 30. Accordingly, the piston 40 is rotated by two times (L2) the eccentric amount (E) of the eccentric portion, causing the compressor to generate the minimum refrigerating capacity.

Here, the piston 40 has a stroke (L2) shorter than a stroke (L1) implemented in the power mode. However, the eccentric sleeve 20 is rotated with the connecting rod 30 with being fixed at the position eccentric from the piston with the maximum state, accordingly the upper dead point of the piston 40 is moved to be nearly same as the upper dead point implemented in the power mode.

Meanwhile, another embodiment of the second latching unit of the reciprocating compressor in accordance with the present invention will be described.

Figure 17:
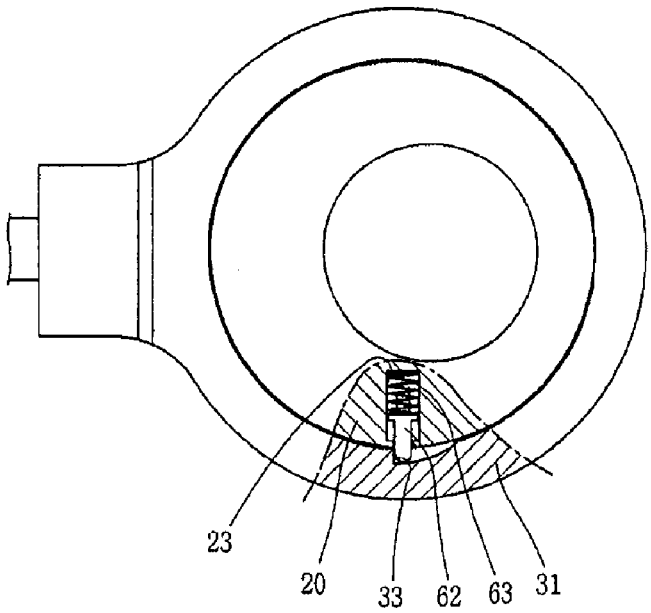
FIG. 17 is a planar view showing a sectional part of another embodiment of the second latching unit in accordance with FIG. 4.

In the aforementioned embodiment, the second latching pin 62 is Installed at the first pin stopper 70, and the second pin stopper 33 locked to or released from the second latching pin 62 is formed at the upper surface of the shaft connecting unit 31 of the connecting rod 30. But, in the embodiment, as shown in FIG. 17, the second latching pin 62 is installed at the outer circumferential surface of the eccentric sleeve 20, and the second stopper 33 corresponding thereto is formed at the inner circumferential surface of the shaft connecting unit 31 of the connecting rod 30, and the vice versa.

Here, a pin mounting groove 23 is formed at one side or both sides of the outer circumferential surface of the eccentric sleeve 20, and the second pin spring 63 implemented as the compression coil spring is inserted into the pin mounting groove 23. And, the second latching pin 62 supported by the second pin spring 63 in the radial direction is inserted into the pin mounting groove 23. Also, the shaft connecting unit 31 contacting with the end of the second latching pin 62 may have the inner circumferential surface through which the second latching pin 62 passes in the power mode, while have the inner circumferential surface provided with the second pin stopper 33 by which the second latching pin 62 is stopped in the saving mode. The second pin stopper 33 may have the inclined surface and the stepped surface consecutively formed as aforementioned embodiment.

The operation of the reciprocating compressor in accordance with this embodiment is similar to that of the aforementioned embodiment, thus will be omitted.

The reciprocating compressor in accordance with the present invention may have the following advantages.

The reciprocating compressor is configured to have the latching unit by which the eccentric sleeve and the connecting rod are rotated together by being locked to each other when the crankshaft is rotated in the forward direction, causing the compressor to be operated in the saving mode, while the eccentric sleeve and the connecting rod are rotated separately from each other not being locked to each other when the crankshaft is rotated in the reverse direction, causing the compressor to be operated in the power mode. Thus, when the crankshaft is rotated in the forward direction, the piston is reciprocated by two times the eccentric amount (E) of the eccentric portion, while, when the crankshaft is rotated in the reverse direction, the piston is reciprocated by two times the total eccentric amount ($E+\epsilon$) obtained by adding the eccentric amount (E) to the eccentric amount ($\epsilon$) of the eccentric sleeve. Accordingly, the piston is controlled to have the same upper dead point in both power and saving modes, thereby being capable of reducing the dead volume between the piston and the discharge valve and increasing the variable ratio of the cooling capacity in the saving mode.

The reciprocating compressor in accordance with the present invention may be used for any device having the variable cooling capacity, such as a home refrigerator and an industrial freezing apparatus.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A reciprocating compressor comprising:

a crankshaft bidirectionally rotating and having an eccentric unit disposed to be eccentric from a center of the rotation;

an eccentric sleeve eccentrically inserted onto the eccentric unit of the crankshaft;

a connecting rod having one end inserted onto the eccentric sleeve and another end coupled to a piston slidably inserted into a cylinder;

a first latching unit installed between the eccentric unit of the crankshaft and the eccentric sleeve, wherein the first latching unit operates in a saving mode as the connecting rod and the eccentric sleeve are locked to each other and a first bearing surface is provided between the eccentric unit of the crankshaft and the eccentric sleeve upon forward rotation of the crankshaft;

a second latching unit installed between the eccentric sleeve and the connecting rod, wherein the second latching unit operates in a power mode as the eccentric unit of the crankshaft and the eccentric sleeve are locked to each other and a second bearing surface is provided between the connecting rod and the eccentric sleeve upon reverse rotation of the crankshaft, wherein the first latching unit comprises a first latching pin coupled to the eccentric unit of the crankshaft to protrude in a radial direction and elastically supported by the eccentric unit;

a first pin stopper having a hole and both ends whose inner circumferential surfaces are spaced from the center of the eccentric unit of the crankshaft with different distances, wherein one of the both ends of the first pin stopper is stopped by the first latching pin according to a rotation direction of the crankshaft so as to make the eccentric unit of the crankshaft and the eccentric sleeve locked to each other, the second latching unit comprises a second latching pin housing located outside the eccentric sleeve and coupled to the first pin stopper, a second latching pin passing through the hole of the first pin stopper and elastically supported in the second latching pin housing to protrude in an axial direction of the crankshaft; and a second pin stopper provided at the connecting rod and having an inclined surface and a stepped surface, the second pin stopper allowing the second latching pin to be stopped thereat or released therefrom in a sliding manner in a circumferential direction according to the rotation direction of the crankshaft.

2. The reciprocating compressor of claim 1, wherein the first latching pin and the first pin stopper are locked to each other at a position that the eccentric portion of the crankshaft is eccentric from the piston with a maximum state.

3. The reciprocating compressor of claim 1, wherein the second latching pin is coupled to a member forming the first latching unit by being coupled to the eccentric sleeve.

4. The reciprocating compressor of claim 1, wherein the piston has an upper dead point approximately the same in the saving mode and the power mode.

* * * * *